US007900679B2

(12) United States Patent
Kinugasa et al.

(10) Patent No.: US 7,900,679 B2
(45) Date of Patent: Mar. 8, 2011

(54) TRANSFER TOOL

(75) Inventors: Shuji Kinugasa, Osaka (JP); Hideto Shima, Kyoto (JP)

(73) Assignee: Kokuyo Co., Ltd., Osaka-shi, Osaka (JP)

( * ) Notice: Subject to any disclaimer, the term of this patent is extended or adjusted under 35 U.S.C. 154(b) by 471 days.

(21) Appl. No.: 12/149,792

(22) Filed: May 8, 2008

(65) Prior Publication Data

US 2009/0028620 A1 Jan. 29, 2009

(30) Foreign Application Priority Data

Jul. 27, 2007 (JP) ..... P2007-196636

(51) Int. Cl.
*B32B 37/26* (2006.01)
*B26F 3/02* (2006.01)
*B43L 19/00* (2006.01)

(52) U.S. Cl. ..... 156/577; 156/523; 156/527; 156/579; 118/200; 118/257; 242/588; 242/588.3; 242/588.6; 242/160.2; 242/160.4; 242/170; 242/171; 206/411

(58) Field of Classification Search ..... 156/523, 156/527, 538, 574, 577, 579; 118/76, 200, 118/257; 225/46; 206/411; 242/160.2, 160.4, 242/170, 171, 588, 588.2, 588.3, 588.6
See application file for complete search history.

(56) References Cited

U.S. PATENT DOCUMENTS

| | | | | |
|---|---|---|---|---|
| 6,422,284 | B1 * | 7/2002 | Kelders et al. | 156/540 |
| 7,784,517 | B2 * | 8/2010 | Sakanishi | 156/540 |
| 2006/0244558 | A1 * | 11/2006 | Kinugasa et al. | 335/202 |

FOREIGN PATENT DOCUMENTS

| | | | |
|---|---|---|---|
| EP | 1 547 810 | A2 | 6/2005 |
| JP | 11170775 | A * | 6/1999 |
| JP | 2003-54190 | A | 2/2003 |
| JP | 2006-305839 | | 11/2006 |
| JP | 2006-305839 | A | 11/2006 |

* cited by examiner

*Primary Examiner* — Mark A Osele
(74) *Attorney, Agent, or Firm* — McGinn IP Law Group, PLLC

(57) ABSTRACT

The present invention provides a transfer tool in which a transfer tape supplied from a supply reel rotatable around a spindle is wound around a winding reel through a transfer head, comprising a transfer tool body which holds at least the supply reel and the winding reel, the transfer head provided on the transfer tool body, a head cap which is pivotally mounted on the transfer tool body or the transfer head through a pivot shaft portion and which can turn between a close position where the transfer head is covered and an open position where the transfer head is exposed, and an urging mechanism provided near the pivot shaft portion, the urging mechanism elastically capable of urging the head cap, toward the close position when the head cap is located closer to the close position than a dead point provided at only one location near an intermediate portion between the close position and the open position, and toward the open position when the head cap is located closer to the open position than the dead point.

4 Claims, 13 Drawing Sheets

TRANSFER TOOL

BACKGROUND OF THE INVENTION

1. Field of the Invention

The present invention relates to a transfer tool including a case member having a head cap which can turn between a close position where a transfer head is covered and an open position where a transfer head is exposed.

2. Background of the Related Art

Conventionally, in a transfer tool in which a transfer tape supplied from a supply reel rotatable around a spindle is wound around a winding reel through a transfer head, a structure in which a refill which holds the supply reel, the transfer head and the winding reel is provided with a head cap which can cover the transfer head is widely used. In the transfer tool having such a structure, there is conceived a structure in which the head cap can be locked at any of the close position where the transfer head is covered and the open position where the transfer head is exposed near the pivot shaft of the head cap (see Japanese Patent Application Laid-open No. 2006-305839 for example).

In the structure described in Japanese Patent Application Laid-open No. 2006-305839, a recess formed in the head cap and a projection provided on a cover are engaged with each other and the head cap is locked only by moving the head cap to the close position or the open position. With such a structure, however, when an operator moves the head cap to a position near the close position or the open position and discontinues moving the head cap thereabout, since the recess and the projection are not engaged with each other, a problem that the head cap moves from a position near the close position toward the open position and the transfer head is exposed after the transfer operation is completed may occur.

SUMMARY OF THE INVENTION

The present invention has been accomplished to solve the problem.

That is, the present invention provides a transfer tool in which a transfer tape supplied from a supply reel rotatable around a spindle is wound around a winding reel through a transfer head, comprising a transfer tool body which holds at least the supply reel and the winding reel, the transfer head provided on the transfer tool body, a head cap which is pivotally mounted on the transfer tool body or the transfer head through a pivot shaft portion and which can turn between a close position where the transfer head is covered and an open position where the transfer head is exposed, and an urging mechanism provided near the pivot shaft portion, the urging mechanism elastically capable of urging the head cap, toward the close position when the head cap is located closer to the close position than a dead point provided at only one location near an intermediate portion between the close position and the open position, and toward the open position when the head cap is located closer to the open position than the dead point.

With this structure, when the head cap is located between the close position and the open position, the head cap is reliably urges selectively toward the close position and the open position by the urging mechanism, and the head cap is held in any of the close position and the open position. Therefore, it is possible to avoid a problem that the head cap moves from a position near the close position toward the open position when the transfer tool is not used and the transfer head is exposed, or a problem that the head cap moves from a position near the open position toward the close position when the transfer tool is used and the head cap is suspended toward a transfer face.

As one example of a concrete structure of the urging mechanism, there is one in which the urging mechanism comprises a projection provided on the pivot shaft portion and a cam face provided near a bearing portion engaging with the pivot shaft portion and slidable on the projection, the head cap is urged by elastically deforming a portion of the head cap near the projection or a portion of the transfer tool body provided with the cam face in a state where the projection and the cam face abut against each other. With this structure, when the projection abuts against the cam face, any of the head cap provided with the projection and the bearing portion provided with the cam face elastically retracts.

As one structure for further concretely realizing the urging mechanism, there is one in which the head cap includes a cap body capable of covering a transfer tape passage of the transfer head in the close position, a pair of connecting arms extending from both side edges of the case body, and a pivot shaft portion which is provided on one end of the connecting arm and which is capable of engaging with a bearing portion provided on the cap body, and when the cam face abuts against the projection provided on the pivot shaft portion, the connecting arm is capable of elastically deforming.

As another structure for further concretely realizing the urging mechanism, there is one in which the head cap includes a cap body which is capable of covering a transfer tape passage of the transfer head in the close position, a pair of connecting arms extending from both side edges of the cap body, and a pivot shaft portion provided on one end of the connecting arm and capable of engaging with a bearing portion provided on the cap body, the bearing portion includes a pair of bearing elements which extend from the case body and which are provided at their tip ends with bearing recesses in which the pivot shaft portion can be accommodated, and as a projection provided on the pivot shaft turns, at least one of the bearing elements is capable of elastically deforming in a direction separating away from the other bearing element.

According to the structure of the transfer tool of the present invention, when the head cap is located between the close position and the open position, the head cap is reliably urges selectively toward the close position and the open position by the urging mechanism, and the head cap is held in any of the close position and the open position. Therefore, it is possible to avoid a problem that the head cap moves from a position near the close position toward the open position after the transfer operation is completed and the transfer head is exposed, or a problem that the head cap moves from a position near the open position toward the close position when the transfer tool is used and the head cap is suspended toward a transfer face.

DETAILED DESCRIPTION OF THE PREFERRED EMBODIMENTS

An embodiment of the present invention will be explained with reference to the drawings.

Figure 1:
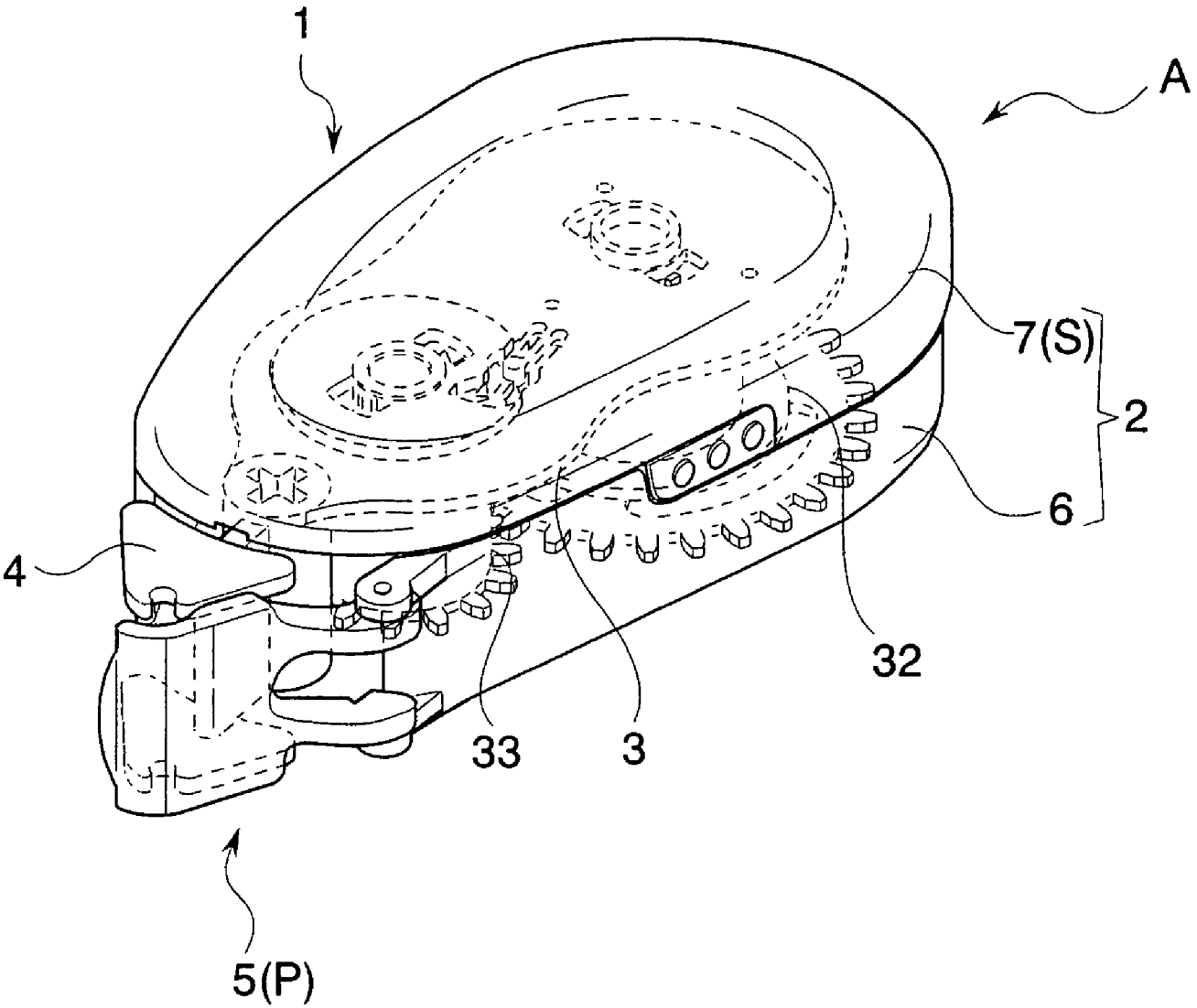
FIG. 1 is a perspective view of a state where a head cap of a transfer tool according to an embodiment of the present invention is disposed in a close position.
Figure 2:
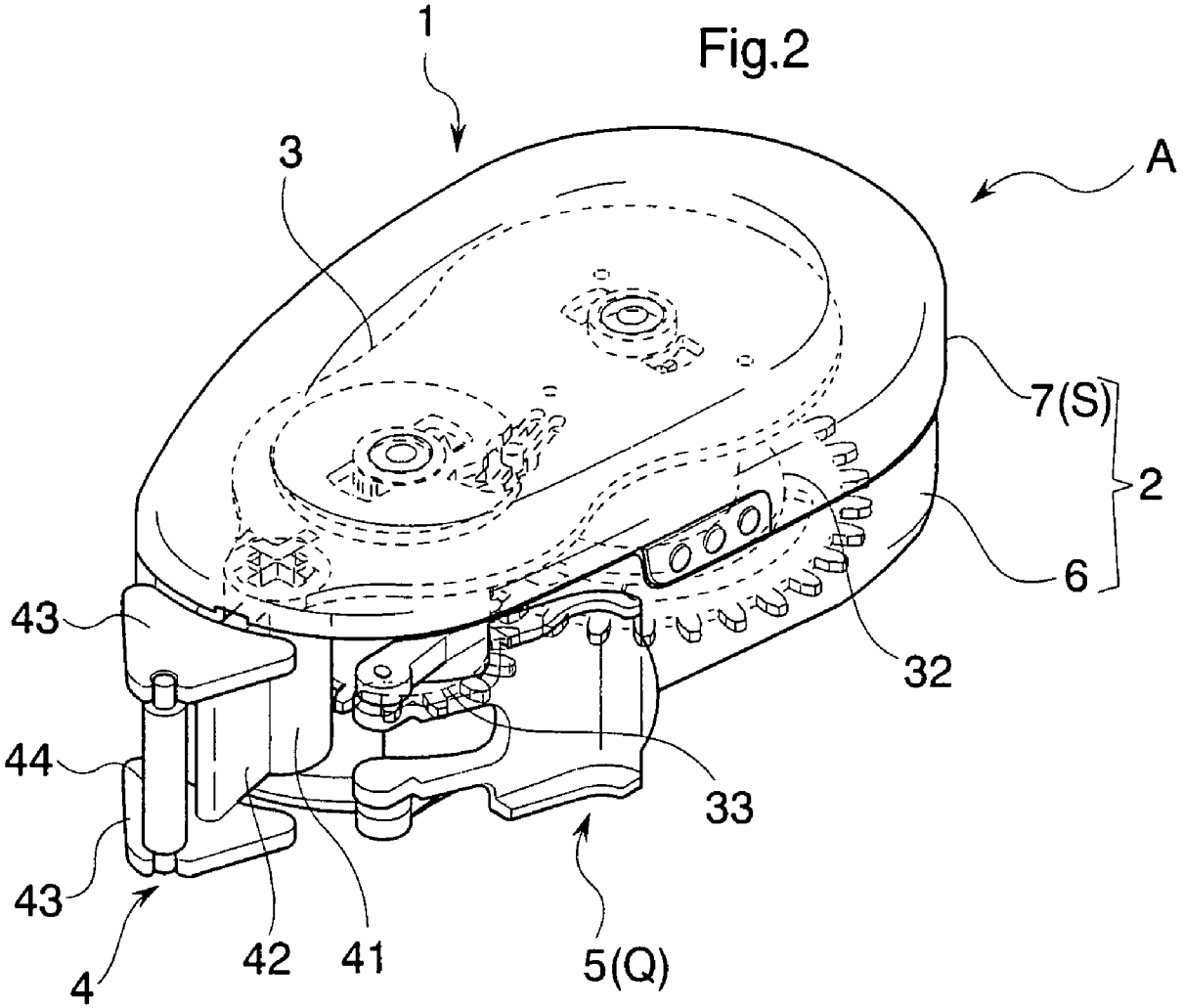
FIG. 2 is a perspective view of a state where the head cap of the transfer tool of the embodiment is disposed in an open position.
Figure 3:
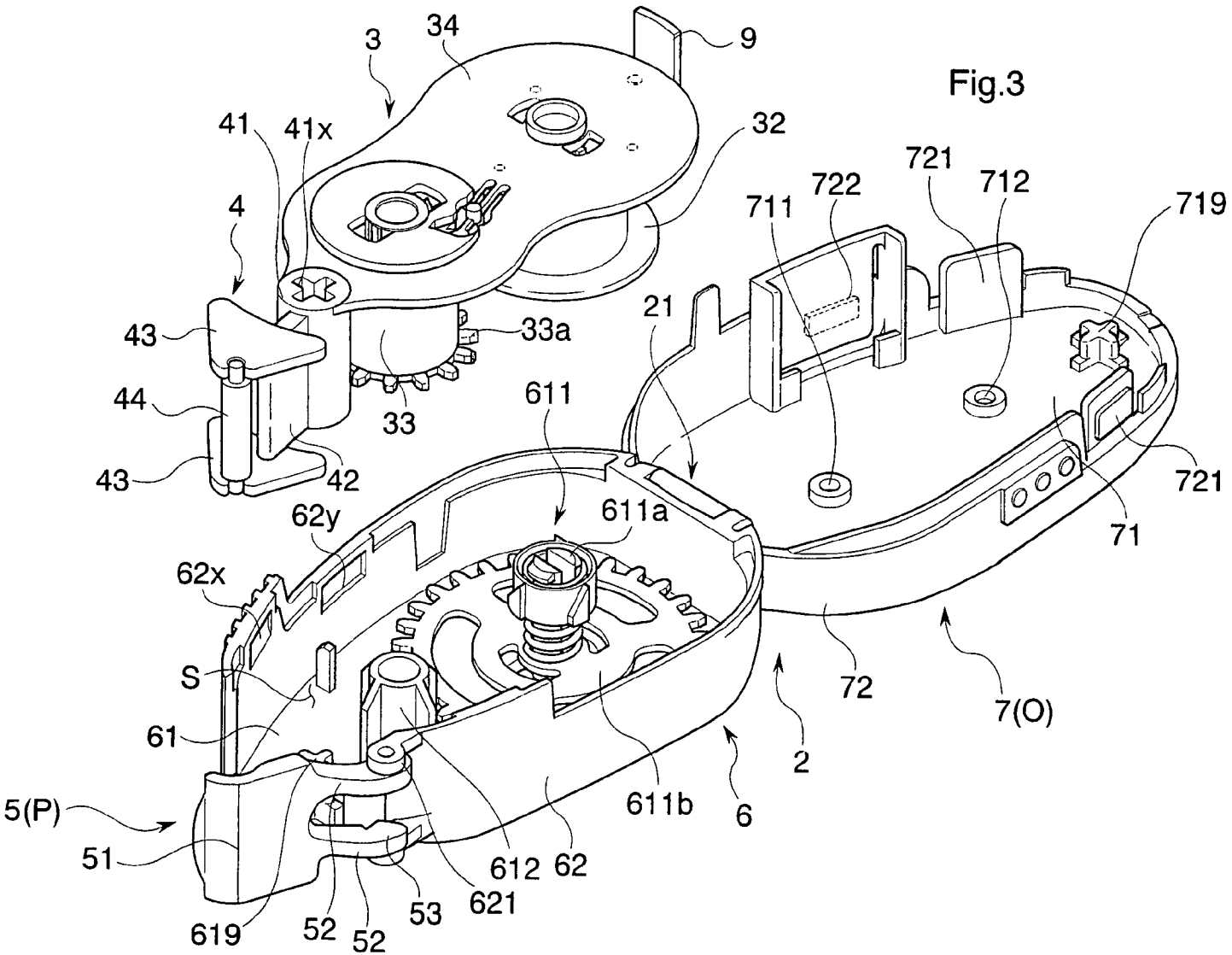
FIG. 3 is an exploded perspective view of the transfer tool of the embodiment.
Figure 4A:
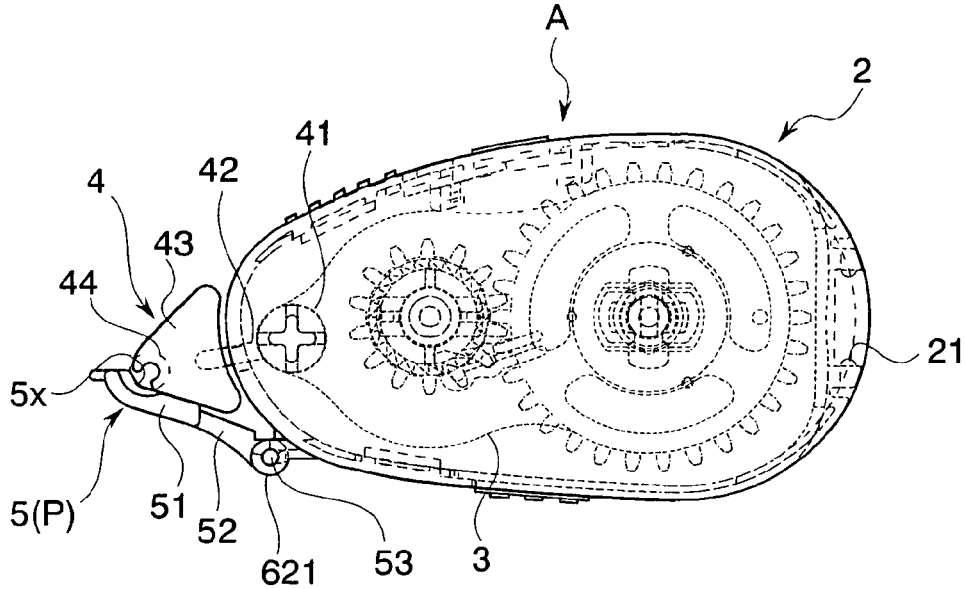
FIGS. 4A, 4B, and 4C are a plan view, a side view and a central vertical sectional view of the transfer tool according to the embodiment.
Figure 4B:
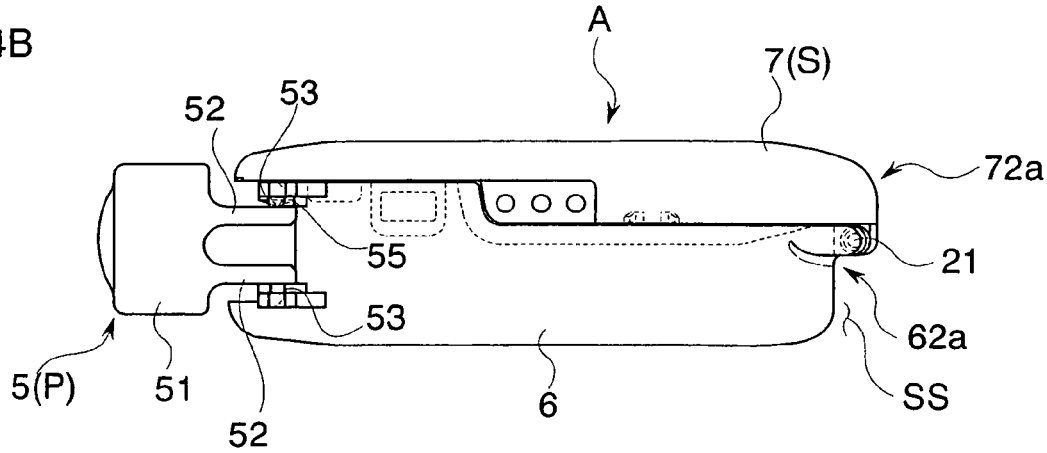
Figure 4C:
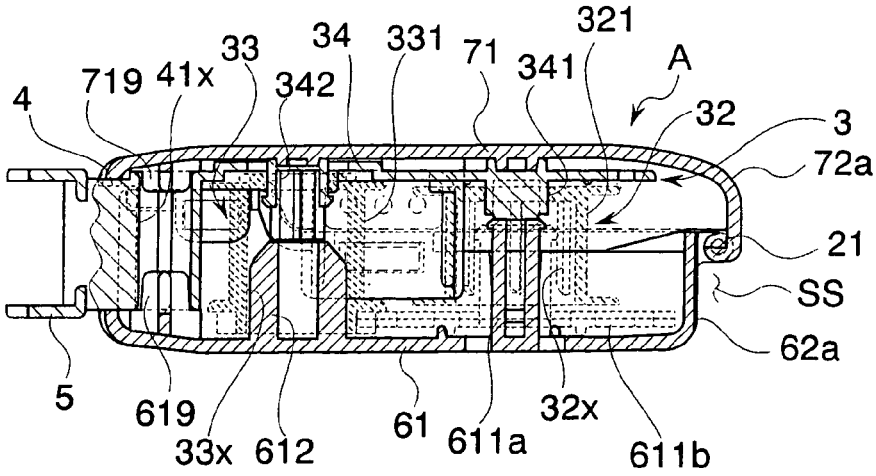

As shown in FIGS. 1 to 5, a transfer tool A according to the embodiment includes a transfer tool body 1 having a case portion 2 and a refill 3 which can hold the case portion 2, a transfer head 4 which is held by the transfer tool body 1, more specifically by the refill 3, and a head cap 5 which is pivotally attached to the transfer tool body 1, more specifically to the case portion 2. FIG. 1 is a perspective view of a state where the head cap 5 of the transfer tool A is disposed in a later-described close position P. FIG. 2 is a perspective view of a state where the head cap 5 of the transfer tool A is disposed in a later-described open position Q. FIG. 3 is an exploded perspective view of the transfer tool A. FIG. 4A is a side view of the transfer tool A, FIG. 4B is a bottom view of the transfer tool A, and FIG. 4C is a vertical sectional view taken along the center of the transfer tool A.

Parts constituting the transfer tool A will be explained below. In the following explanation, unless otherwise specified, "front" means a side where the transfer head 4 exists and "back" means a side opposite from the transfer head 4. An example of a transferring object is paste, or a correcting ink coating film or the like for correcting a character or a figure written or printed on a paper sheet or a film which is an object to be transferred.

As described above, the transfer tool body 1 includes the case portion 2 and the refill 3 which is detachably held in the case portion 2. The case portion 2 includes a first case 6, a second case 7 which pairs off with the first case 6, and a hinge 21 which connects the first and second cases 6 and 7 such that they can relatively move between a use position S and an open position O.

Figure 5:
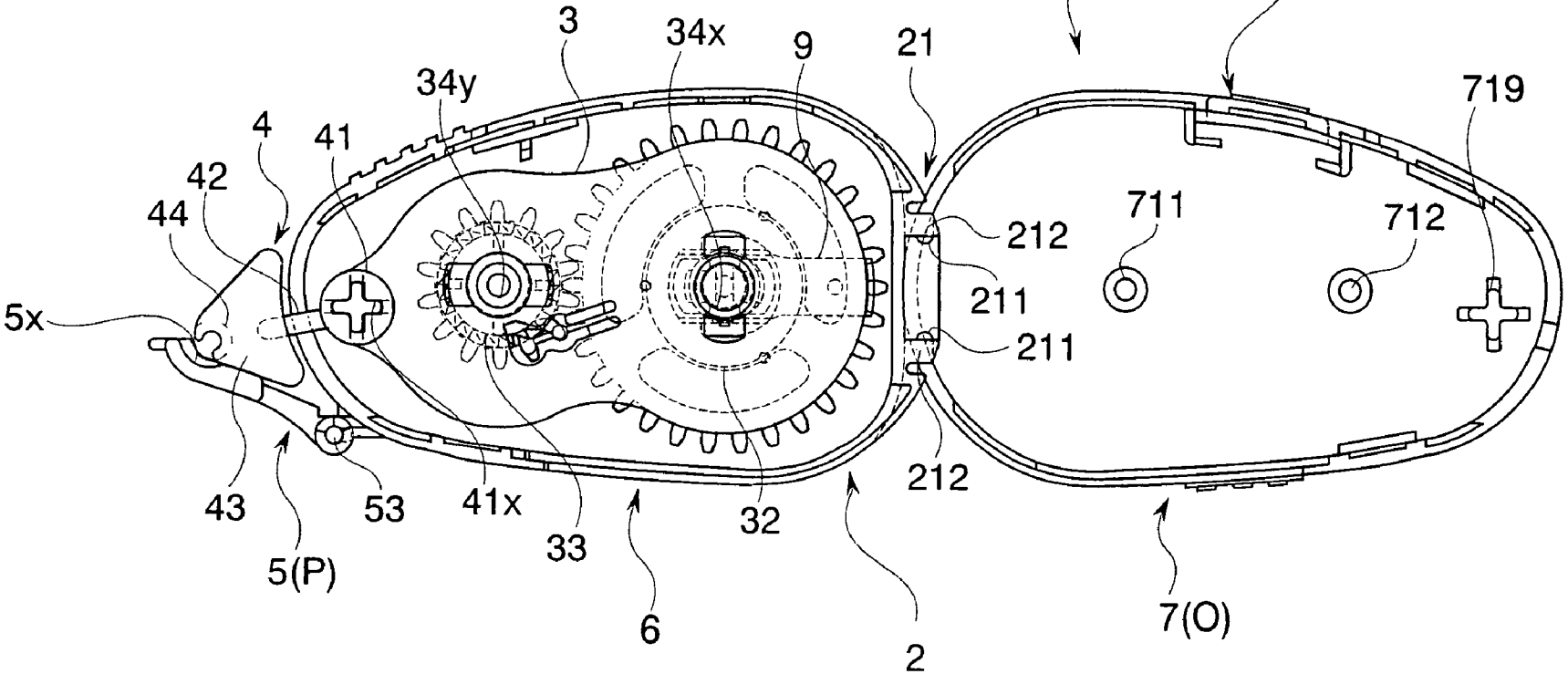
FIG. 5 is a side view of a state where the first and second cases of the transfer tool of the embodiment are relatively moved to the open position.
Figure 6A:
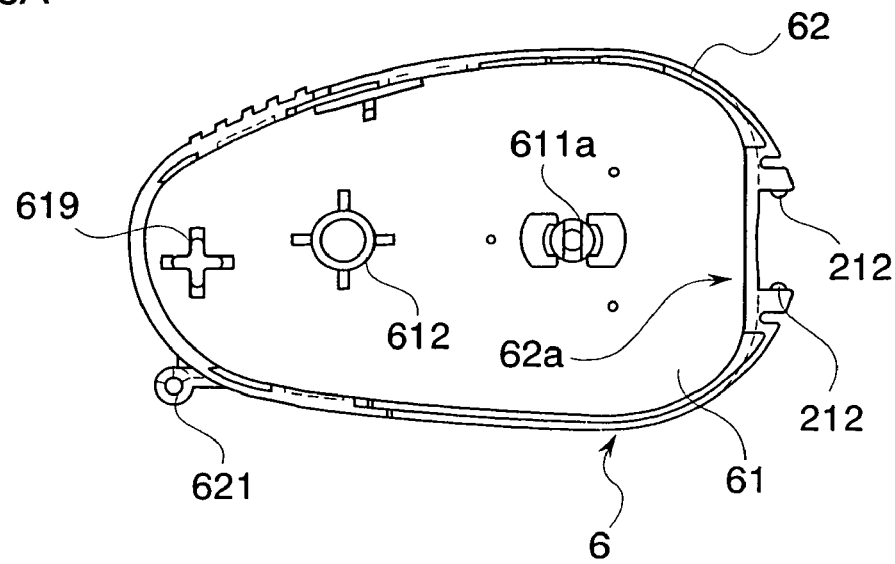
FIGS. 6A, 6B, and 6C are a plan view, a side view and a central vertical sectional view of the first case of the transfer tool according to the embodiment.
Figure 6B:
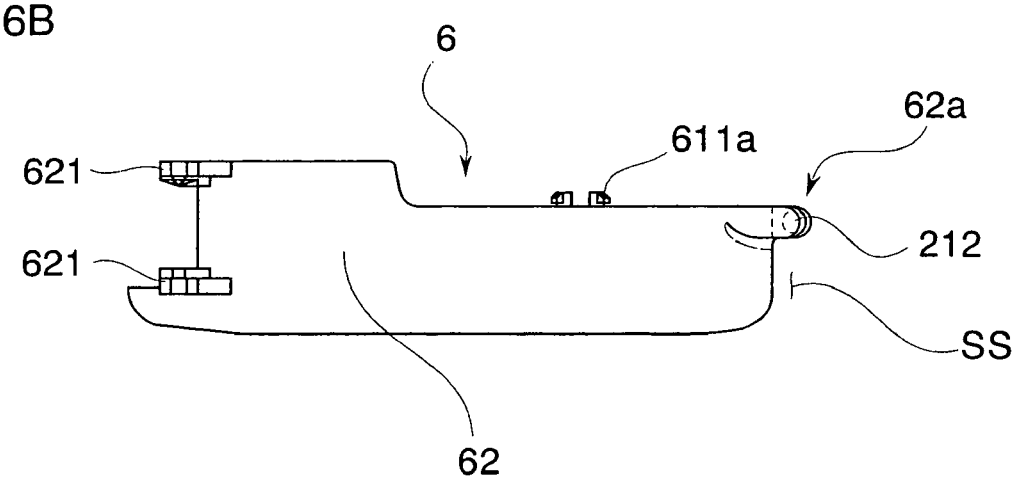
Figure 6C:
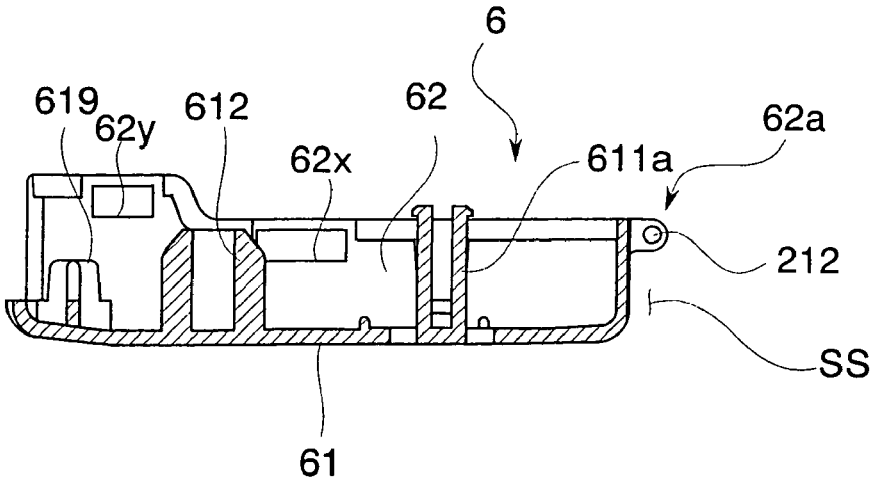

Constituent parts of the case portion 2 will be explained in more detail. As shown in FIG. 6, the first case 6 includes a main wall 61 forming a main body of the first case 6, and an outer wall 62 which is integrally formed on the main wall 61 and which surrounds the main wall 61. In the first case 6, a refill accommodation space S in which the refill 3 can be accommodated is formed. The refill accommodation space S is defined by the main wall 61 and the outer wall 62. FIG. 5 is a side view of a state where the first and second cases 6 and 7 of the transfer tool A of the embodiment are relatively moved to the open position O. FIGS. 1, 2 and 4 show a state where the first and second cases 6 and 7 are relatively moved to the use position S. FIG. 6A is a side view of the first case 6, FIG. 6B is a bottom view of the first case 6 and FIG. 6C is a sectional view taken along the center of the first case 6.

The main wall 61 is provided therein with a supply reel mounting portion 611 for rotatably mounting a supply reel 32 of the refill 3, and a winding reel mounting portion 612 for rotatably supporting a winding reel 33 of the refill 3. The supply reel mounting portion 611 includes a supply reel support portion 611*a* which can rotate together with the supply reel 32 if the supply reel support portion 611*a* is inserted into a later-described meshing hole (not shown) of the supply reel 32, and a drive gear 611*b* which is coaxially mounted on the supply reel support portion 611*a* through a slide mechanism (not shown). The winding reel mounting portion 612 is integrally formed from the main wall 61 into a substantially cylindrical shape, and the winding reel mounting portion 612 can be inserted into a later-described winding reel mounting hole (not shown) formed in a tip end of the winding reel 33.

The outer wall 62 projects from a portion of the outer edge of the main wall 61 except the front end. The rear end of the outer wall 62 is formed as a hinge corresponding portion 62*a* to provide the hinge 21 on the rear end of the outer wall 62. An outer peripheral surface of the hinge corresponding portion 62*a* is continuous with an outer peripheral surface of other portion of the outer wall 62. The transfer head 4 passes through a head-exposing opening and is exposed outside. The head-exposing opening is a portion where the outer wall 62 is not provided.

Figure 7A:
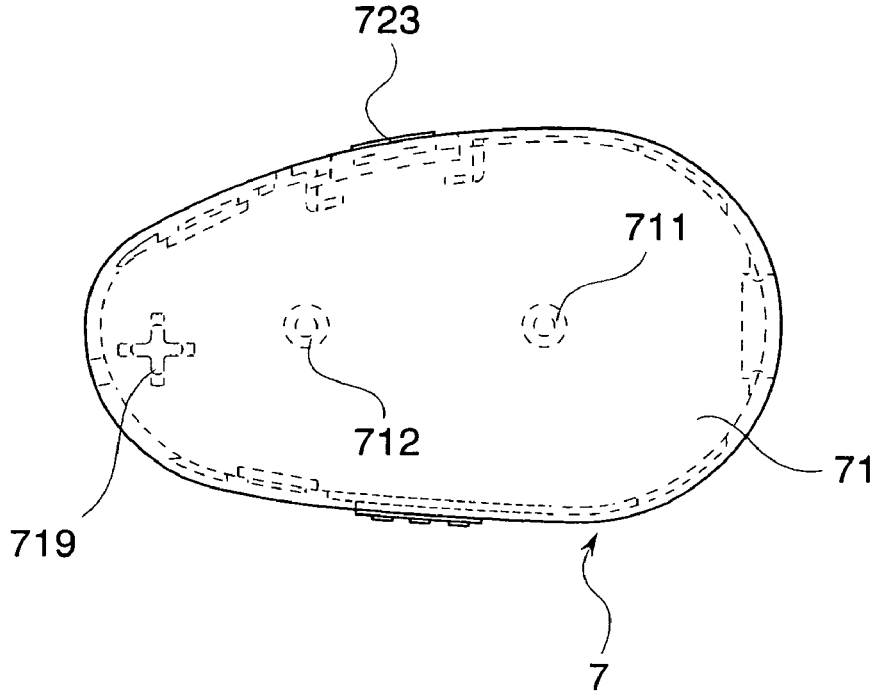
FIGS. 7A, 7B, and 7C are a plan view, a side view and a central vertical sectional view of the second case of the transfer tool according to the embodiment.
Figure 7B:
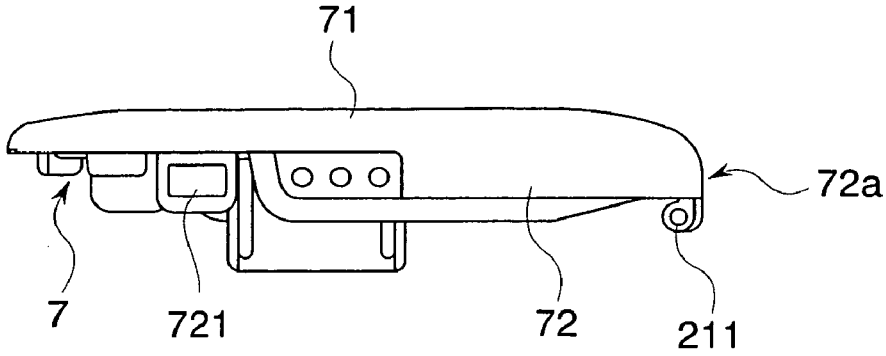
Figure 7C:
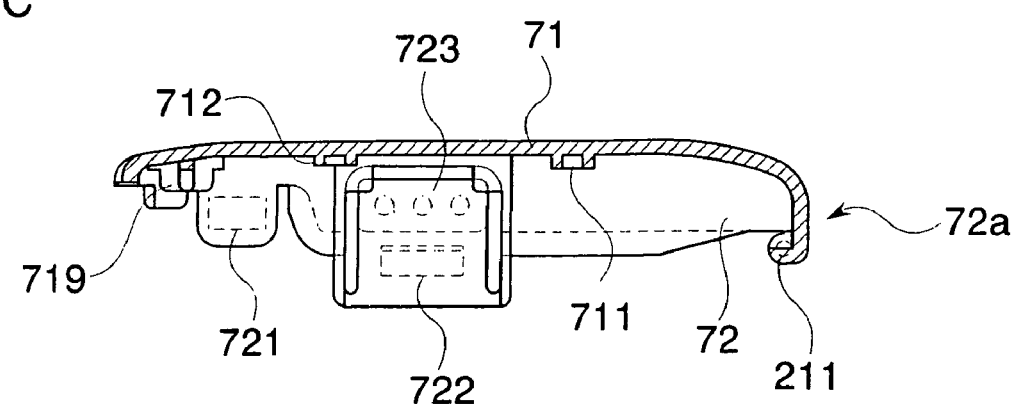

As shown in FIG. 7, the second case 7 includes a lid 71 which substantially closes the refill accommodation space S of the first case 6, and an outer wall 72 which projects from an outer edge of the lid 71 and its projecting end is overlapped on an outer wall 62 of the first case 6. FIG. 7A is a side view of the second case 7, FIG. 7B is a bottom view of the second case 7 and FIG. 7C is a vertical sectional view taken along the center of the second case 7.

The lid 71 is formed with insertion projections 711 and 712 which can be fitted into supported holes 34*x* and 34*y* formed in a support plate 34 at two locations corresponding to centers of the supply reel 32 and the winding reel 33.

To provide the hinge 21 on the rear end of the outer wall 72, the rear end of the outer wall 72 is formed as a hinge corresponding portion 72*a*. An outer peripheral surface of the hinge corresponding portion 72*a* is continuous with an outer peripheral surface of the other portion of the outer wall 72.

Front engaging part and rear engaging part are provided between the first case 6 and the second case 7 to realize a reliable engagement between the first and second cases 6 and 7. The front engaging part engages a front engaging recess 62*x* formed in a front portion of the outer wall 62 of the first case 6 and a front engaging pawl 721 provided on the outer wall 72 of the second case 7 at a location where a position thereof in the longitudinal direction matches with the front engaging recess 62*x* in the use position S with each other. The rear engaging part engages a rear engaging recess 62*y* provided at a central portion of the outer wall 62 of the first case 6 in the longitudinal direction and a rear engaging pawl 722 with each other. The rear engaging pawl 722 is provided on a portion of the outer wall 72 of the second case 7 which matches with the rear engaging recess 62*y* in the use position S in the longitudinal direction. The rear engaging pawl 722 can move between an engaging position where the rear engaging pawl 722 engages with the rear engaging recess 62*y* and a separating position where the rear engaging pawl 722 is separated from the rear engaging recess 62*y*. An operating portion 723 is provided near the rear engaging pawl 722. If the operating portion 723 receives an operating force, the rear engaging pawl 722 elastically deforms and moves from the engaging position to the separating position.

On the other hand, the hinge 21 connects the first and second cases 6 and 7 with each other such that the cases can relatively move between the use position S and the open position O as described above. In this embodiment, the hinge 21 is provided inward of the outer edge of the second case 7. More specifically, the hinge 21 is formed by utilizing a shaft member 211 projecting from the second case 7, and a pair of bearings 212 and 212 which are provided on the first case 6 and which pivotally support the shaft member 211 from both sides thereof. An evacuation space SS is provided near the hinge 21 of the first case 6, preferably in front of the bearings 212 and 212 for receiving the second case 7 in the close position Q.

The transfer tool A of the embodiment further includes a transmission mechanism which is provided between the first case 6 and the refill 3 for transmitting rotation of the supply reel 32 to the winding reel 33.

The refill 3 is held between the first case 6 and the second case 7. The refill 3 includes the supply reel 32 which holds an unused transfer tape in a state, the unused transfer tape being wounded on the supply reel 32 in the state, the winding reel 33 around which a used transfer tape film is wound, and a support plate 34 which rotatably supports the supply reel 32 and the winding reel 33 and which integrally holds the transfer head 4.

The transfer head 4 can transfer a transferring object provided on a transfer tape to an object to be transferred. In this embodiment, the transfer head 4 is supported by the refill 3, and the refill 3 and the transfer head 4 are integrally handled.

As shown in FIG. 4, the supply reel 32 includes a supply reel body 321 forming a main body of the supply reel 32, and a meshing hole 32*x* which can accommodate the supply reel 32 when a transfer tape is pulled out from the supply reel support portion 611*a* such that rotation of the supply reel 32 can be transmitted and the meshing hole 32*x* meshes with the supply reel support portion 611*a*.

As shown in FIG. 4, the winding reel 33 includes a winding reel body 331 forming a main body of the winding reel 33, a winding reel mounting hole 33*x* which can accommodate the winding reel mounting portion 612 such that the winding reel mounting hole 33*x* can rotate with respect to the winding reel mounting portion 63, and a follower gear 33*a* which is formed on a peripheral edge of the winding reel mounting hole 33*x* and which can mesh with the drive gear 611*b*. That is, in this embodiment, the supply reel support portion 611*a* and the drive gear 611*b* which constitute the supply reel mounting portion 611, and the follower gear 33*a* constitutes the transmitting mechanism.

As shown in FIG. 4, a front end of the support plate 34 supports a base end 41 of the transfer head 4 such that the base end 41 can not rotate. The support plate 34 is provided at its surface opposed to the first case 6 with a supply reel holding portion 341 and a winding reel holding portion 342 which rotatably hold the supply reel 32 and the winding reel 33, respectively. Supported holes 34*x* and 34*y* are formed in the surface of the support plate 34 opposed to the second case 7 at locations corresponding to centers of the supply reel 32 and the winding reel 33, respectively.

Figure 9A:
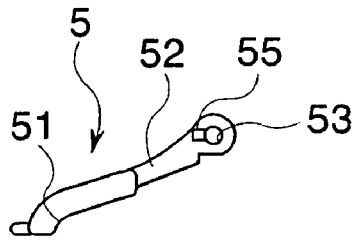
FIGS. 9A, 9B, 9C, and 9D are a right side view, a bottom view, a plan view and a left side view of the head cap of the embodiment.
Figure 9B:
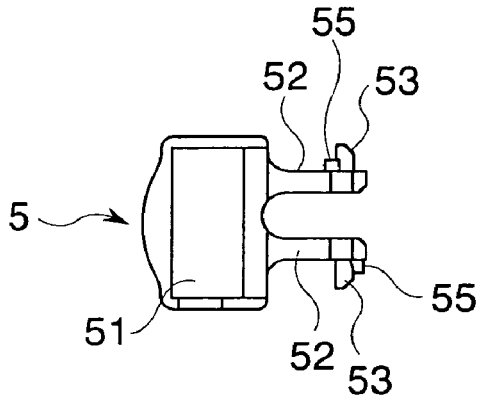
Figure 9C:
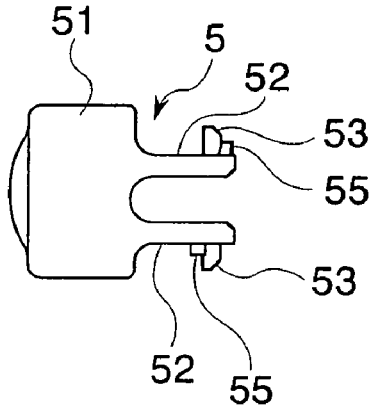
Figure 9D:
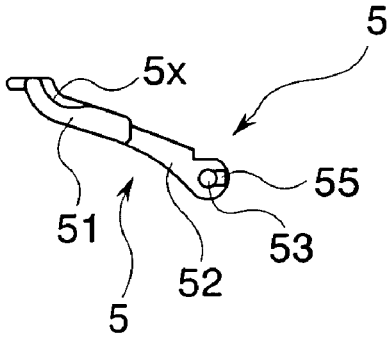
Figure 10A:
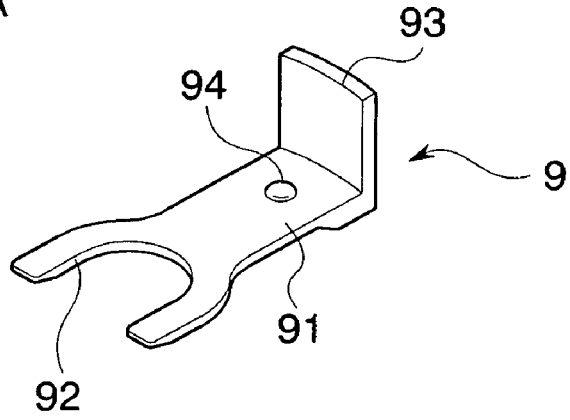
FIGS. 10A, 10B, 10C, and 10D are a perspective view, a front view, a side view and a plan view of a stopping member of the embodiment.
Figure 10B:
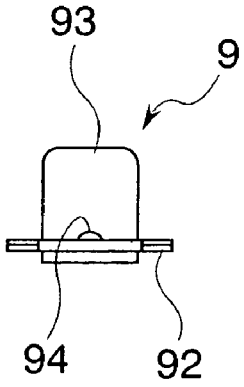
Figure 10C:
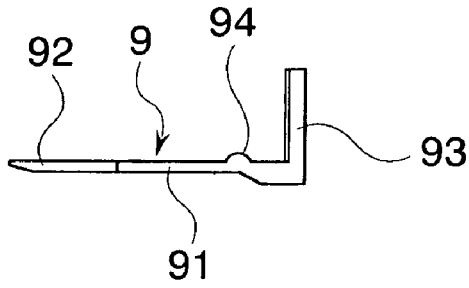
Figure 10D:
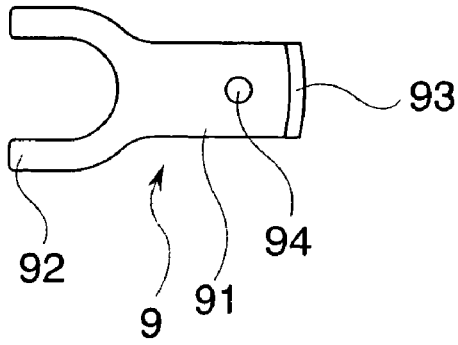

In addition, a stopping member 9 can be inserted and pulled out between the supply reel 32 and the support plate 34 to prevent the supply reel 32 from rotating when the refill 3 is transported alone. As shown in FIG. 10, the stopping member 9 includes a stopping body 91 inserted between the supply reel 32 and the support plate 34, an abutting portion 92 which is provided on one end of the stopping body 91 and which abuts against the supply reel support portion 611*a* of the first case 6 when the stopping member 9 is disposed to a predetermined inserting position, a knob 93 which is provided on the other end of the stopping body 91 and which projects toward the second case 7 in a state where the refill 3 is mounted on the first case 6, and a projection 94 which is provided on one surface of the stopping body 91 and which can be engaged with an engaging recess 34*z* formed in the support plate 34 when the stopping member 9 is disposed in the predetermined inserting position. FIG. 10A is a perspective view of the stopping member 9, FIG. 9B is a front view of the stopping member 9, FIG. 10C is a side view of the stopping member 9 and FIG. 10D is a plan view of the stopping member 9.

As shown in FIGS. 3 and 5, the transfer head 4 includes a base end 41 integrally formed on the support plate 34 of the refill 3, an extension plate 42 extending forward from the base end 41, restriction plates 43 and 43 formed on both sides of the extension plate 42 as outer plates, and a transfer roller 44 which is rotatably supported by tip ends of the restriction plates 43 and 43 as folding back guide portion. The base end 41 is set such that the base end 41 can slightly deform when the transfer head 4 which is being used is pressed in this embodiment. The restriction plates 43 and 43 are provided for stably moving the transfer tape while suppressing deviation of the transfer tape sideway and for transferring the transferring object to the object which is to be transferred. That is, a transfer tape passage is formed between the restriction plates 43 and 43. A surface of the transfer roller 44 is made of material which can elastically deform so as to press the transfer tape against the object to be transferred. An engaging portion which can prohibit the relative turning motion between the base end 41 and the case portion 2 (i.e., first case 6 and second case 7) is provided between the base end 41 of the transfer head 4, the first case 6 and the second case 7. This engaging portion is provided on the base end 41 of the transfer head 4, and engages a cross groove 41*x* opening in a width direction of the transfer tool A and cross ribs 619 and 719 provided on the first case 6 and the second case 7 with each other.

The head cap 5 is pivotally supported by the first case 6 through the pivot shaft 53. The head cap 5 can turn between the close position P where the head cap 5 can cover a tip end of the transfer head 4 and an open position Q where the tip end of the transfer head 4, i.e., at least the restriction plates 43 and 43 and the transfer roller 44 are exposed.

More specifically, as shown in FIG. 9, the head cap 5 includes a cap body 51 which is opposed to a lower surface of the restriction plate 43 of the transfer head 4 in the close position P (surface to be opposed to an object to be transferred) and which cover a tip lower end of the transfer head 4, connecting arms 52 extending from both end edges of the cap body 51, and a pivot shaft portion 53 which is provided on an end of the connecting arm 52 and which is pivotally supported on a cap receiver 621 provided on the outer wall 62 of the first case 6. The head cap 5 is located outside of an inserting and pulling out locus of the transfer head 4 when the head cap 5 is disposed in the close position P. In this embodiment, the inserting and pulling out locus of the transfer head 4 is a locus of the transfer head 4 from a position where the transfer head 4 which is integrally constituted with the refill 3 is mounted on the first case 6 to a position where it is moved by the longitudinal size of the supply reel mounting portion 611, i.e., a projecting width from the main wall 61 in the pulling out direction. That is, the head cap 5 has a shape which is not overlapped on the transfer head 4 as viewed from side in the pulling out direction when the head cap 5 is disposed in the close position P. In other words, the head cap 5 can form a head inserting and pulling out space so that the transfer head 4 can move in the inserting and pulling out direction of the transfer head 4 in the pulling out direction of the transfer head 4. The head cap 5 includes a head accommodating recess 5*x* in which the transfer roller 44 of the transfer head 4 can be accommodated when the head cap 5 is disposed in the close position P. FIG. 9A is a right side view of the head cap 5, FIG. 9B is a bottom view of the head cap 5, FIG. 9C is a plan view of the head cap 5 and FIG. 9D is a left side view of the head cap 5.

Figure 8A:
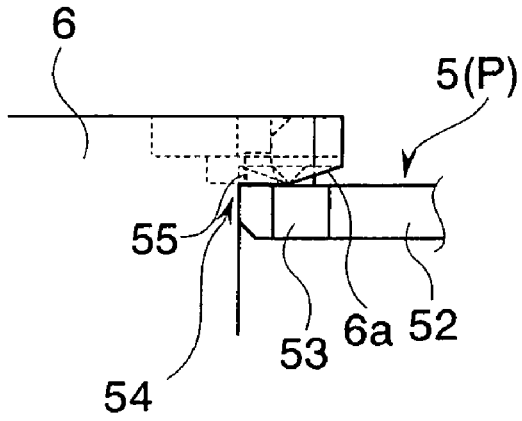
FIGS. 8A, 8B, and 8C are an explanatory diagram of effect of the urging mechanism of the transfer tool of the embodiment.
Figure 8B:
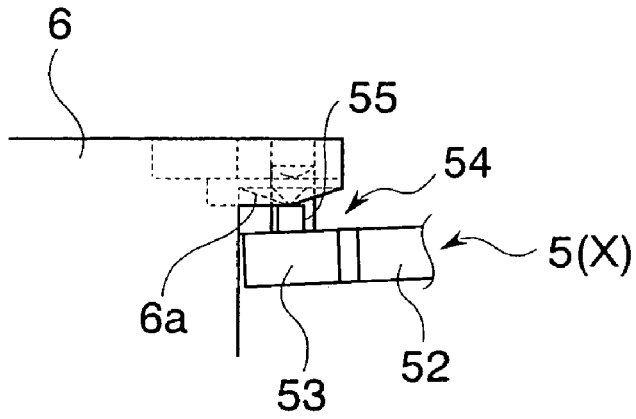
Figure 8C:
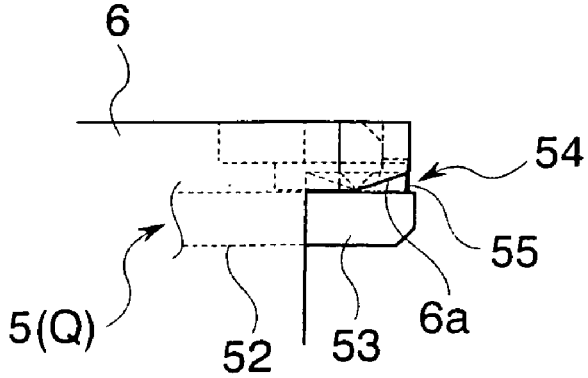

An urging mechanism 54 which selectively elastically urges the head cap 5 toward the close position P or the open position Q is provided in the vicinity of the pivot shaft portion 53 of the head cap 5. More specifically, as shown in FIG. 8, a projection 55 projects from the pivot shaft portion 53, and a cam face portion 6*a* which can slide on the projection 55 is provided adjacent to the bearing of the first case 6. The cam face portion 6*a* and the projection 55 slide on each other, the projection 55 and other connecting arm 52 provided on the pivot shaft portion 53 are elastically deformed, and they move toward the other connecting arm 52. The cam face portion 6*a* has only one dead point X at which a distance between the dead point X and the axis of the pivot shaft portion 53 becomes minimum and the moving amount of the connecting arm 52 becomes maximum when the head cap 5 is located at an intermediate location between the close position P and the open position Q. The cam face portion 6*a* urges the head cap 5 toward the close position P if the head cap 5 is closer to the close position P, and toward the open position Q if the head cap 5 is closer to the open position Q. FIG. 8A shows a state where the head cap 5 is disposed in the close position P, FIG. 8B shows a state where the head cap 5 is disposed at the dead point X, and FIG. 8C shows a state where the head cap 5 is disposed in the open position Q.

As described above, according to the transfer tool A of the embodiment, the transfer tape T supplied from the supply reel rotatable around the spindle is wound around the winding reel 33 through a transfer head. The transfer tool A includes a transfer tool body 1 which holds at least the supply reel 32 and the winding reel 33, the transfer head 4 provided on the transfer tool body 1, concretely, on the refill 3, the head cap 5 which is pivotally mounted on the transfer tool body 1, more specifically, on the case portion 2 through the pivot shaft portion 53, and which can turn between the close position P where the transfer head 4 is covered and the open position Q where the transfer head 4 is exposed, and an urging mechanism 54 provided near the pivot shaft portion 53 capable of elastically urging the head cap 5, toward the close position P when the head cap 5 is located closer to the close position P than the dead point provided at only one location near an intermediate portion between the close position P and the open position Q, and toward the open position Q when the head cap 5 is located closer to the open position Q than the dead point. Thus, when the head cap 5 is located between the close position P and the open position Q, the head cap 5 is reliably urged by the urging mechanism 54 selectively toward the close position P and the open position Q, and the head cap 5 is held in any of the close position P and the open position Q. Therefore, it is possible to avoid a problem that after the transfer operation is completed, the head cap 5 is moved toward the open position Q from a position near the close position P and the transfer head 4 is exposed, and a problem that when the transfer tool A is used, the head cap 5 is moved toward the close position P from a position near the open position Q and the head cap 5 is suspended toward the transfer face.

The urging mechanism 54 comprises a projection 55 provided on the pivot shaft portion 53, and a cam face 6*a* which is provided near the cap receiver 621 and which can slide with the projection 55. The urging mechanism 54 has such a structure that in a state where the projection 55 and the cam face 6*a* abut against each other, a portion of the head cap 5 near the projection 55, more specifically the connecting arm 52 is retracted by elastic deformation, and the head cap 5 is urged by the elasticity. Therefore, it is possible to realize the urging mechanism 54 with a simple structure without adding a special part such as a torsion coil spring or the like.

The present invention is not limited to the above-described embodiment.

For example, a structure as will be described with reference to FIGS. 11 to 13 may be employed in a connection between the transfer tool body and the head cap. In the following description, portions corresponding to those in the above-described embodiment will be designated with the same names and the same symbols.

Figure 12A:
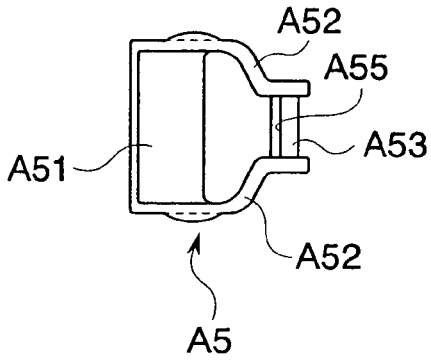
FIGS. 12A, 12B, 12C, and 12D are a bottom view, a side view and a central vertical sectional view, and a plan view of the head cap of the embodiment.
Figure 12B:
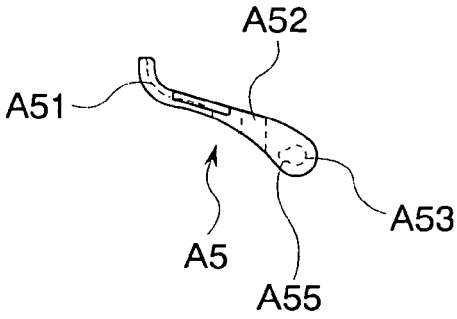
Figure 12C:
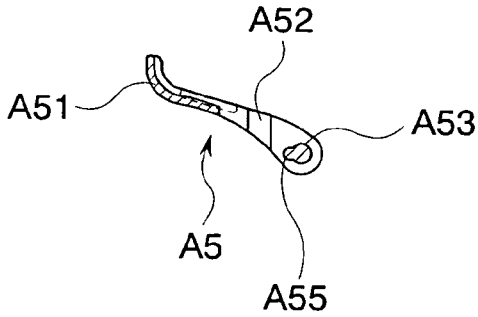
Figure 12D:
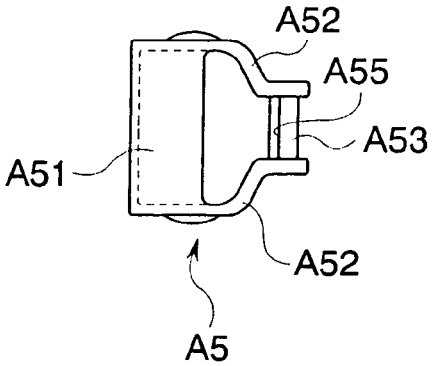

A head cap A5 in this structure includes a cap body A51 capable of covering a transfer tape passage of the transfer head 4 in the close position P, a pair of connecting arms A52 extending from both side edges of the cap body A51, and a pivot shaft portion A53 which is provided on one end of each of the connecting arms A52 and which can be engaged with the head cap receiver A621 which is a bearing provided on the cap body 1. A projection A55 constituting the urging mechanism A54 is provided near the pivot shaft A53. FIG. 12A is a bottom view of the head cap 5, FIG. 12B is a side view of the head cap 5, FIG. 12C is a central vertical sectional view of the head cap 5 and FIG. 12D is a plan view of the head cap 5.

Figure 11A:
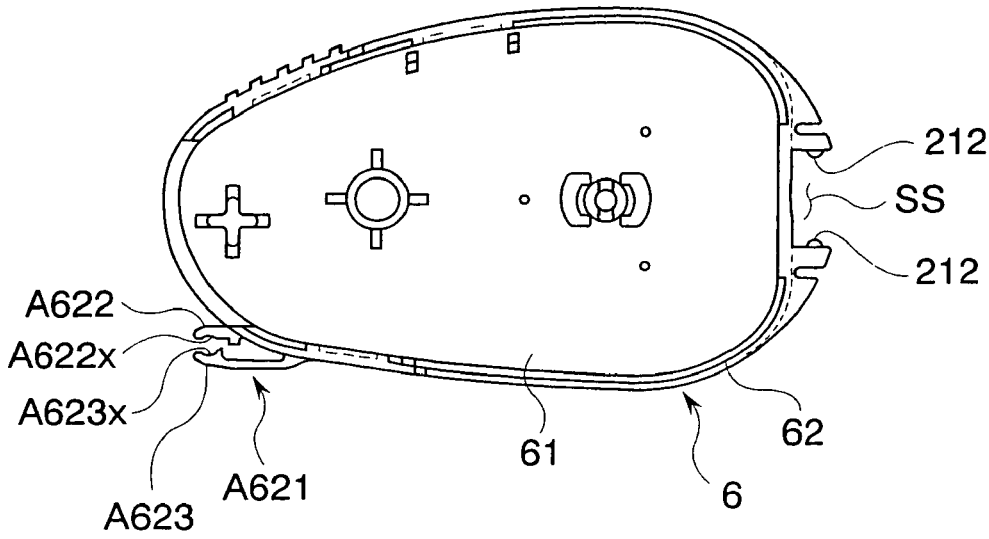
FIGS. 11A, 11B, and 11C are a plan view, a side view of the first case and an enlarged view near a head cap receiver according to another embodiment of the present invention.
Figure 11B:
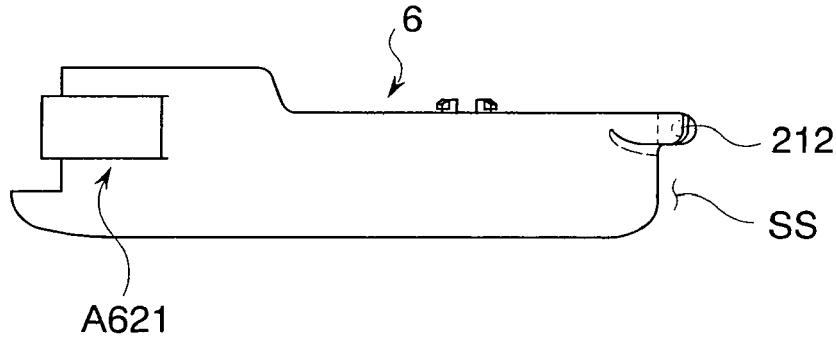
Figure 11C:
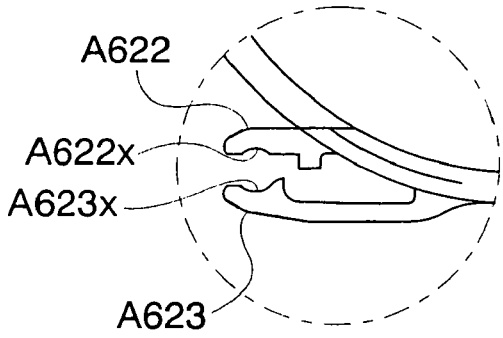

The transfer tool body 1 of this structure is provided with the head cap receiver A621 extending outward from the first case 6. The head cap receiver A621 includes a pair of first and second bearing elements A622 and A622 provided at their tip ends with bearing recesses A622X and A623X in which the pivot shaft portion A53 can be accommodated. The first bearing element A622 is provided on a side closer to the first case 6, and the second bearing element A623 is provided on a side further from the first case 6. The bearing recess A623X of the second bearing element A623 constitutes the urging mechanism A54. FIG. 11A is a plan view of the first case 6 of the embodiment, FIG. 11B is a side view of the first case 6 and FIG. 11C is an enlarged view near the head cap receiver A621.

The urging mechanism A54 which selectively elastically urges the head cap A5 to one of the close position P and the open position Q is provided near the pivot shaft portion A53 of the head cap A5. In this structure, other portions of the transfer tool A have the same structures as those of the above-described embodiment.

Figure 13A:
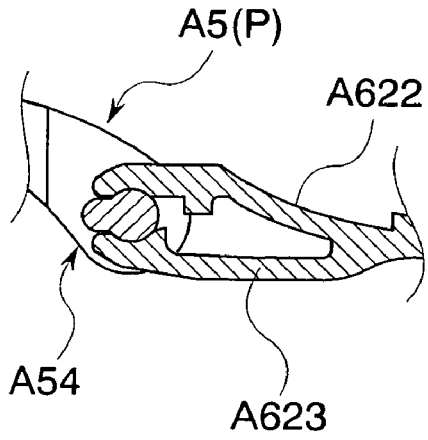
FIGS. 13A, 13B, and 13C are an explanatory diagram of effect of an urging mechanism of the transfer tool of the embodiment.
Figure 13B:
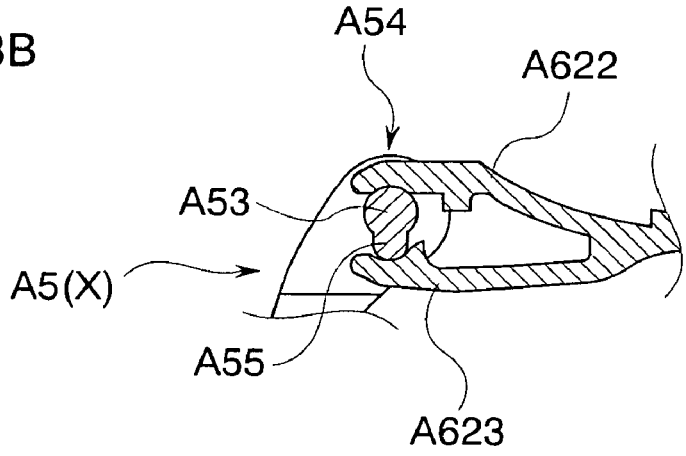
Figure 13C:
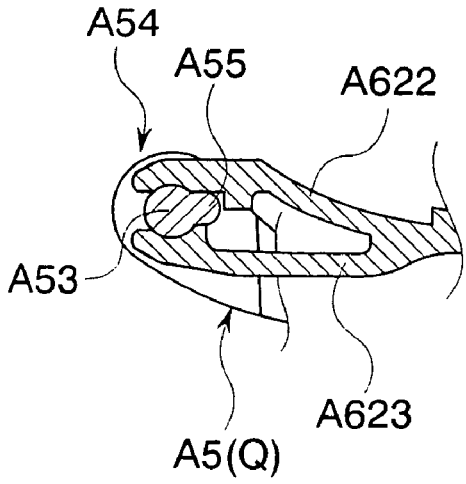

When the head cap A5 is located in the close position P or the open position Q, as shown in FIGS. 13A and 13C, the projection A55 is located in a space between the first and second bearing elements A622 and A623. When the head cap A5 is located in a position other than the close position P and the open position Q on the other hand, the bearing recess A623*x* of the second bearing element A623 is pressed against the projection A55, the second bearing element A623 is elastically deformed and is separated from the first bearing element A622. The urging mechanism A54 receives the elasticity from the second bearing element A623. If the head cap A5 is located closer to the close position P than the dead point located in an intermediate portion between the close position P and the open position Q, the urging mechanism A54 urges the head cap A5 toward the close position P, and if the head cap A5 is located closer to the open position Q than the dead point, the urging mechanism A54 urges the head cap A5 toward the open position Q. FIG. 13A shows a state where the head cap A5 is disposed in the close position P, FIG. 13B shows a state where the head cap A5 is disposed at the dead point X, and FIG. 13C shows a state where the head cap A5 is disposed in the open position Q.

With this structure also, it is possible to realize the urging mechanism A54 with a simple structure without adding a special part such as a torsion coil spring or the like.

Elasticity of the head cap itself or elasticity generated by elastic deformation of the bearing portion of the case may not be utilized. For example, the urging mechanism may have permanent magnets disposed near the tip end of the head cap body, and portions of the case opposed to the head caps located in the close position and the open position may be provided.

A bearing portion pivotally supporting the pivot shaft portion of the head cap may be provided on the transfer head instead of the transfer tool body. That is, the head cap may pivotally be mounted on the transfer head.

In addition, the present invention can be variously be modified within a range not departing from the subject matter of the present invention.

What is claimed is:

1. A transfer tool in which a transfer tape supplied from a supply reel rotatable around a spindle is wound around a winding reel through a transfer head, comprising:

a transfer tool body which holds at least the supply reel and the winding reel;

the transfer head provided on the transfer tool body;

a head cap which is pivotally mounted on the transfer tool body or the transfer head through a pivot shaft portion and which can turn between a close position where the transfer head is covered and an open position where the transfer head is exposed; and an urging mechanism provided near the pivot shaft portion, the urging mechanism capable of elastically urging the head cap, toward the close position when the head cap is located closer to the close position than a dead point provided at only one location near an intermediate portion between the close position and the open position, and toward the open position when the head cap is located closer to the open position than the dead point.

2. The transfer tool according to claim 1, wherein the urging mechanism comprises a projection provided on the pivot shaft portion and a cam face provided near a bearing portion engaging with the pivot shaft portion and slidable on the projection, the head cap is urged by elastically deforming a portion of the head cap near the projection or a portion of the transfer tool body provided with the cam face in a state where the projection and the cam face abut against each other.

3. The transfer tool according to claim 2, wherein the head cap includes a cap body capable of covering a transfer tape passage of the transfer head in the close position, a pair of connecting arms extending from both side edges of the case body, and a pivot shaft portion which is provided on one end of the connecting arm and which is capable of engaging with a bearing portion provided on the cap body, and when the cam face abuts against the projection provided on the pivot shaft portion, the connecting arm is capable of elastically deforming.

4. The transfer tool according to claim 2, wherein the head cap includes a cap body which is capable of covering a transfer tape passage of the transfer head in the close position, a pair of connecting arms extending from both side edges of the cap body, and a pivot shaft portion provided on one end of the connecting arm and capable of engaging with a bearing portion provided on the cap body, the bearing portion includes a pair of bearing elements which extend from the case body and which are provided at their tip ends with bearing recesses in which the pivot shaft portion can be accommodated, and as a projection provided on the pivot shaft turns, at least one of the bearing elements is capable of elastically deforming in a direction separating away from the other bearing element.

* * * * *